US009101807B1

(12) United States Patent
Teeter

(10) Patent No.: US 9,101,807 B1
(45) Date of Patent: Aug. 11, 2015

(54) TIP RESISTANT GOLF BAG ASSEMBLY

(71) Applicant: Ronald Teeter, Fairbault, MN (US)

(72) Inventor: Ronald Teeter, Fairbault, MN (US)

( * ) Notice: Subject to any disclaimer, the term of this patent is extended or adjusted under 35 U.S.C. 154(b) by 0 days.

(21) Appl. No.: 14/048,389

(22) Filed: Oct. 8, 2013

(51) Int. Cl.
*A63B 55/00* (2015.01)
*A63B 55/04* (2006.01)

(52) U.S. Cl.
CPC ..... *A63B 55/04* (2013.01)

(58) Field of Classification Search
CPC ..... A63B 55/00; A47G 19/2261; A47G 2019/2294; Y10S 273/20
USPC ..... 383/104; 220/603; 206/315.6, 315.3, 206/315.8, 315.7; 473/437
See application file for complete search history.

(56) References Cited

U.S. PATENT DOCUMENTS 646,869 A * 4/1900 Perkes ..... 206/315.2
1,384,078 A 7/1921 May
1,672,549 A * 6/1928 Thompson ..... 206/315.6
1,904,731 A * 4/1933 Hastings ..... 206/315.7
3,425,708 A * 2/1969 Fusamatsu ..... 280/47.19
4,268,030 A 5/1981 Richards
4,522,299 A * 6/1985 Clark et al. ..... 206/315.3
4,655,346 A 4/1987 Reinholz
4,942,962 A 7/1990 Jordan
5,505,300 A * 4/1996 Joh ..... 206/315.6
D406,459 S 3/1999 Sundara et al.
5,950,824 A * 9/1999 Millar, Jr. ..... 206/315.5
5,961,426 A 10/1999 Spector
6,186,662 B1 * 2/2001 Jackson ..... 383/16
6,279,740 B1 * 8/2001 Dorman ..... 206/315.3
6,648,137 B2 11/2003 Hamamori
D515,125 S 2/2006 Onuma
7,628,270 B1 * 12/2009 Davis ..... 206/315.7
2006/0006084 A1 1/2006 Burgess et al.
2008/0226205 A1 * 9/2008 Sillik ..... 383/104

* cited by examiner

*Primary Examiner* — Sue A Weaver

(57) ABSTRACT

A tip resistant golf bag assembly includes a perimeter wall having a bottom edge and a top edge. The housing has a height from the bottom edge to the top edge between 30.0 inches and 38.0 inches. The top edge forms an opening extending into the housing. The top edge has a diameter between 8.0 inches and 16.0 inches and a diameter of the perimeter wall increases from the top edge to the bottom edge. A bottom wall is attached to the bottom edge. The bottom wall has a bottom surface has a convexly arcuate surface.

7 Claims, 3 Drawing Sheets

TIP RESISTANT GOLF BAG ASSEMBLY

I hereby claim the benefit under 35 U.S.C. Section 119(e) of any U.S. Provisional application 61/712,447 filed Oct. 11, 2012.

BACKGROUND OF THE DISCLOSURE

Field of the Disclosure

The disclosure relates to golf bag structures and more particularly pertains to a new golf bag structure for retaining the golf bag structure in an upright orientation without stabilizing legs being attached to the golf bag structure.

SUMMARY OF THE DISCLOSURE

An embodiment of the disclosure meets the needs presented above by generally comprising a housing includes a perimeter wall having a bottom edge and a top edge. The housing has a height from the bottom edge to the top edge between 30.0 inches and 38.0 inches. The top edge forms an opening extending into the housing. The top edge has a diameter between 8.0 inches and 16.0 inches and a diameter of the perimeter wall increases from the top edge to the bottom edge. A bottom wall is attached to the bottom edge. The bottom wall has a bottom surface has a convexly arcuate surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
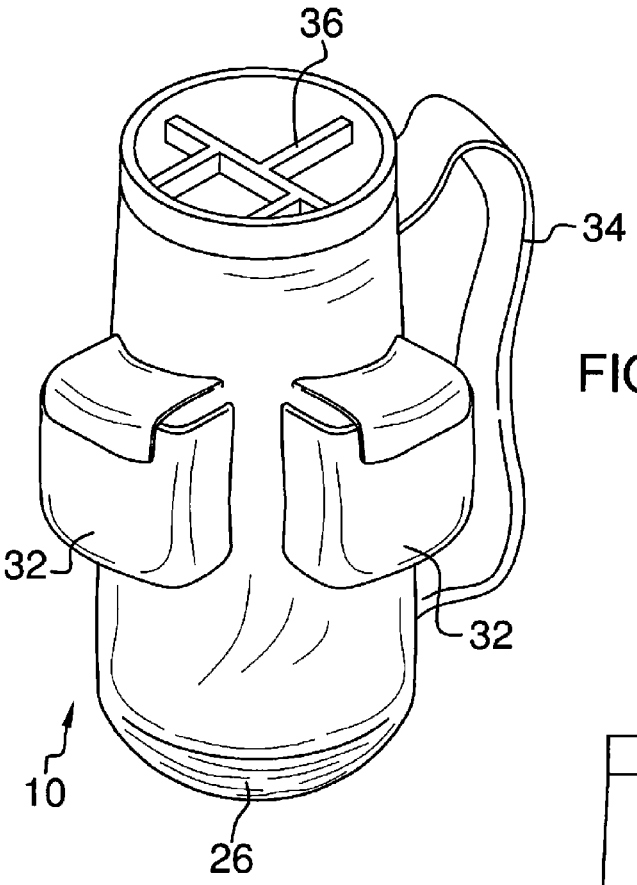
FIG. 1 is a top perspective view of a tip resistant golf bag assembly according to an embodiment of the disclosure.
Figure 2:
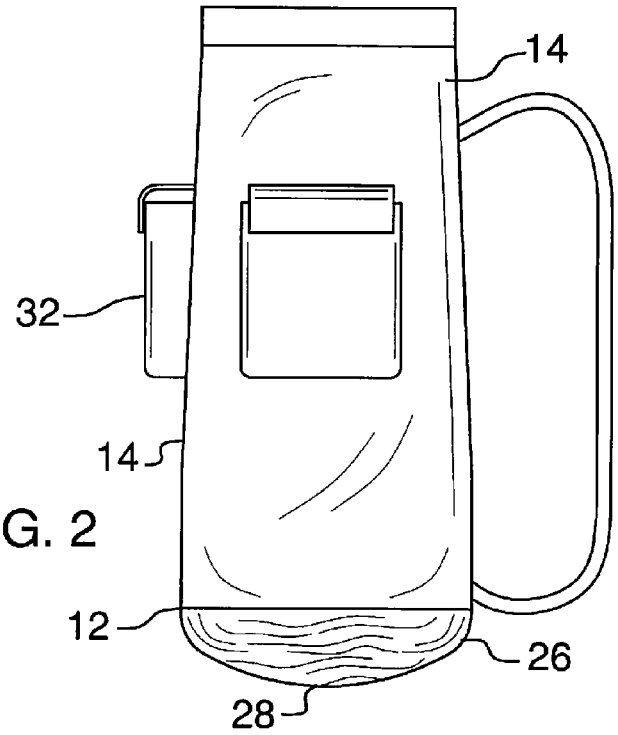
FIG. 2 is a side view of an embodiment of the disclosure.
Figure 3:
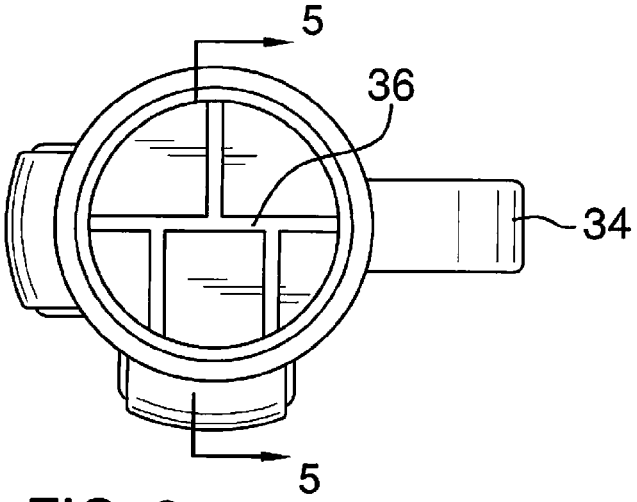
FIG. 3 is a top view of an embodiment of the disclosure.
Figure 4:
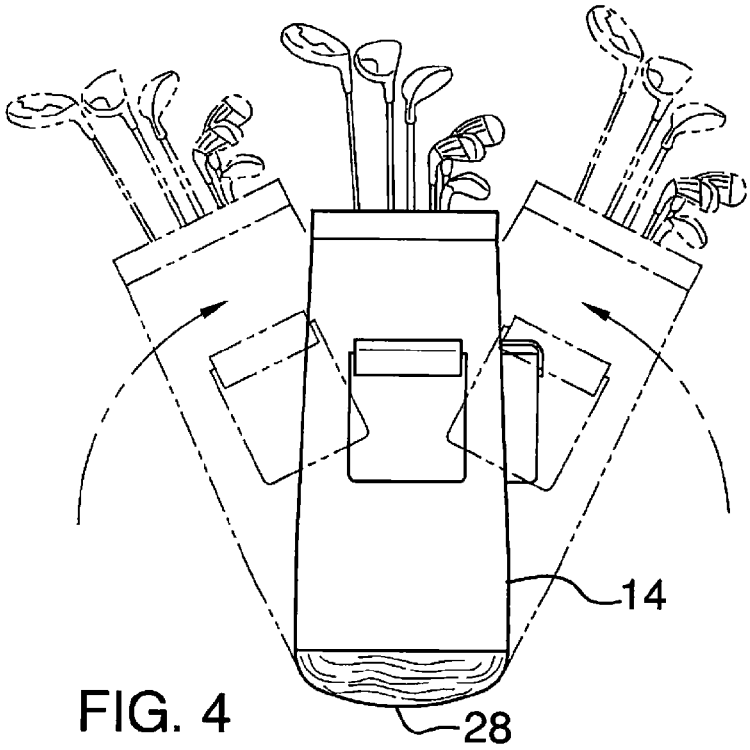
FIG. 4 is a front in-use view of an embodiment of the disclosure.
Figure 5:
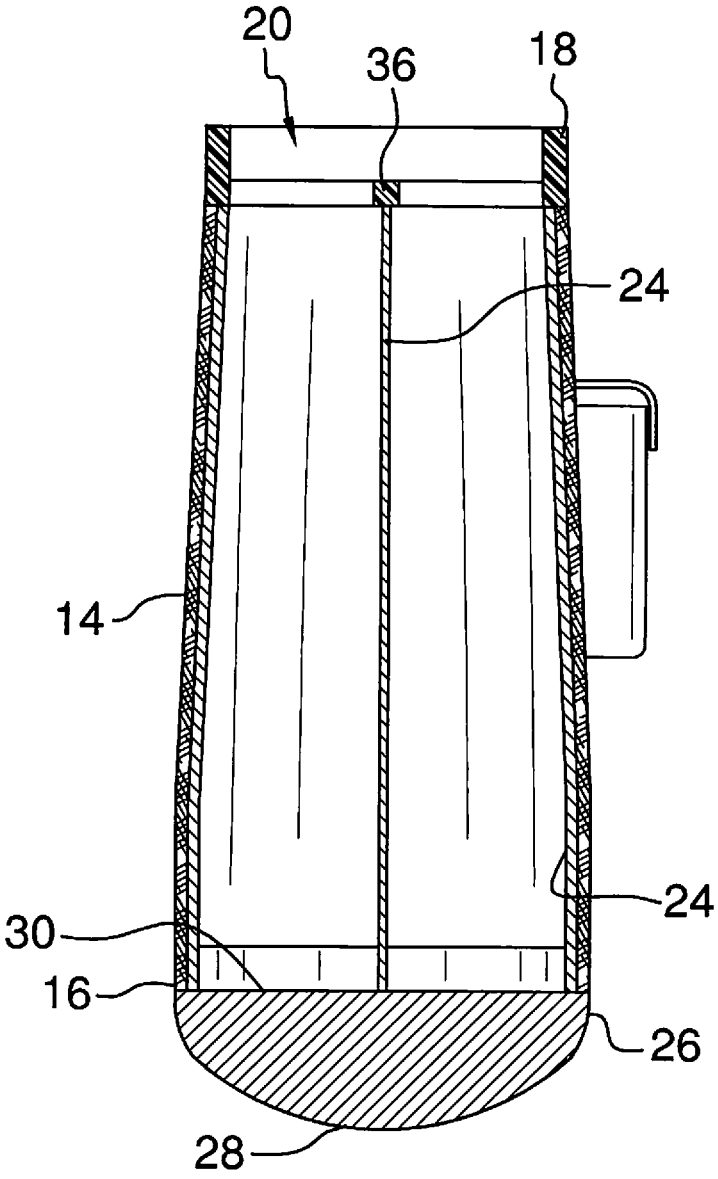
FIG. 5 is a cross-sectional view of an embodiment of the disclosure taken along line 5-5 of FIG. 3.

With reference now to the drawings, and in particular to FIGS. 1 through 5 thereof, a new golf bag structure embodying the principles and concepts of an embodiment of the disclosure and generally designated by the reference numeral 10 will be described.

As best illustrated in FIGS. 1 through 5, the tip resistant golf bag assembly 10 generally comprises a housing 12 including a perimeter wall 14 having a bottom edge 16 and a top edge 18. The housing 12 has a height from the bottom edge 16 to the top edge 18 between 30.0 inches and 38.0 inches. The top edge 18 forms an opening 20 extending into the housing 12 and has a diameter between 8.0 inches and 16.0 inches. A diameter of the perimeter wall 14 increases from the top edge 18 to the bottom edge 16. The perimeter wall 18 may comprise a cloth material positioned on a frame 24 in a conventional manner known in the art of golf bag construction.

A bottom wall 26 is attached to the bottom edge 16. The bottom wall 26 has a bottom surface 28 having a convexly arcuate surface and an upper surface 30 that may be planar. The bottom wall 26 is solid from the upper surface 30 to the bottom surface 28. The bottom wall 26 has a weight greater than 10.0 lbs and may be up to 20.0 lbs. The weight of the bottom wall 26 retains a center of gravity of the assembly 10 nearer to the bottom edge 16 than the top edge 18. Such a condition will ensure that the assembly 10 does not easily tip over and will generally remain in an upright position. The bottom wall 26 is defined generally as the entire space between the upper surface 30 positioned forming the base of an interior of the assembly 10 and the bottom surface 28.

A plurality of pockets 32 is attached to an exterior surface of the housing 12. The pockets 32 may be used for conventional reasons such as holding golf balls, golf tees, gloves and the like. At least one strap 34 is attached to the perimeter wall to facilitate the carrying of the housing. Furthermore, the interior of the housing 12 may include dividers 36 to separate golf clubs from each other. The dividers 36 are removed from FIG. 2 for clarity purposes.

In use, the assembly 10 is used in a conventional manner. However, the shape of the perimeter 14 and bottom 26 walls, as well as the weight of the bottom wall 26, inhibits the falling over of the housing 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A golf bag assembly comprising:

a housing including a perimeter wall having a bottom edge and a top edge, said housing having a height from said bottom edge to said top edge between 30.0 inches and 38.0 inches, said top edge forming an opening extending into said housing, said top edge having a diameter between 8.0 inches and 16.0 inches, a diameter of said perimeter wall increasing from said top edge to said bottom edge, and a bottom wall being attached to said bottom edge, said bottom wall having a bottom surface having a convexly arcuate surface, said bottom wall having a weight between 10.0 lbs and 20.0 lbs.

2. The golf bag assembly according to claim 1, wherein said perimeter wall comprises a cloth material positioned on a frame.

3. The golf bag assembly according to claim 1, wherein said bottom wall has a planar upper surface.

4. The golf bag assembly according to claim 3, wherein said bottom wall is solid from said upper surface to said bottom surface.

5. The golf bag assembly according to claim 1, further including a plurality of pockets being attached to an exterior surface of said housing, at least one strap being attached to said perimeter wall and configured to facilitate carrying of said housing.

6. The golf bag assembly according to claim 1, a plurality of dividers is positioned within said housing and being configured to separate golf clubs from each other.

7. A golf bag assembly comprising:

a housing including a housing including a perimeter wall having a bottom edge and a top edge, said perimeter wall having a height from said bottom edge to said top edge between 30.0 inches and 38.0 inches, said top edge forming an opening extending into said housing, said opening having a diameter between 8.0 inches and 16.0 inches, a diameter of the perimeter wall increasing from said top edge to said bottom edge, said perimeter wall comprising a cloth material positioned on a frame, and a bottom wall being attached to said bottom edge, said bottom wall having a bottom surface having a convexly arcuate surface, said bottom wall having a planar upper surface, said bottom wall being solid from said upper surface to said bottom surface, said bottom wall having a weight between 10.0 lbs and 20.0 lbs;

a plurality of pockets being attached to an exterior surface of said housing, at least one strap being attached to said perimeter wall and configured to facilitate carrying of said housing; and a plurality of dividers being positioned within said housing and being configured to separate golf clubs from each other.

* * * * *